US007040918B2

(12) United States Patent
Moriyama et al.

(10) Patent No.: US 7,040,918 B2
(45) Date of Patent: May 9, 2006

(54) CABLE CONNECTOR FOR DIFFERENTIAL TRANSMISSION

(75) Inventors: Satoshi Moriyama, Shinagawa (JP); Tadashi Kumamoto, Shinagawa (JP); Mitsuru Kobayashi, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 10/902,009

(22) Filed: Jul. 30, 2004

(65) Prior Publication Data

US 2005/0208823 A1 Sep. 22, 2005

(30) Foreign Application Priority Data

Mar. 16, 2004 (JP) ..... 2004-074922

(51) Int. Cl.
*H01R 12/24* (2006.01)

(52) U.S. Cl. ..... 439/497; 439/660

(58) Field of Classification Search ..... 439/101, 439/497, 499, 660

See application file for complete search history.

(56) References Cited

U.S. PATENT DOCUMENTS

| | | | | |
|---|---|---|---|---|
| 5,267,875 | A * | 12/1993 | Koegel et al. | 439/497 |
| 6,482,028 | B1 * | 11/2002 | Kumamoto et al. | 439/498 |
| 6,905,366 | B1 * | 6/2005 | Yang | 439/607 |
| 2003/0060086 | A1 * | 3/2003 | Ozai | 439/660 |

FOREIGN PATENT DOCUMENTS

JP 2003-059593 2/2003

* cited by examiner

*Primary Examiner*—Khiem Nguyen
(74) *Attorney, Agent, or Firm*—Staas & Halsey LLP

(57) ABSTRACT

A differential transmission cable connector is disclosed that includes a contact assembly and an alignment member. In the contact assembly, signal contact pairs of first and second signal contacts and ground contacts are arranged alternately. The first connection part of each first signal contact, the second connection part of each second signal contact, and the drain wire connection part of each ground contact project from the rear side of the contact assembly. The alignment member aligns first and second signal wires extending from a differential transmission cable so that the first and second signal wires are arranged in positions corresponding to the first and second connection parts, respectively. The alignment member is joined to the contact assembly. The first and second signal wires and the drain wires are connected to the first and second connection parts and the drain wire connection parts, respectively.

15 Claims, 17 Drawing Sheets

CABLE CONNECTOR FOR DIFFERENTIAL TRANSMISSION

BACKGROUND OF THE INVENTION

1. Field of the Invention

The present invention relates generally to cable connectors for differential transmission, and more particularly to a cable connector for differential transmission employed to transmit a high-speed signal.

2. Description of the Related Art

There are two types of data transmission methods: a normal transmission method and a differential transmission method. The normal transmission method employs an electric wire for each data item. The differential transmission method, using a pair of electric wires for each data item, simultaneously transmits a "+" signal to be transmitted and a "−" signal equal in magnitude and opposite in direction to the "+" signal. The differential transmission method, which has the advantage of being less susceptible to noise compared with the normal transmission method, has been used more widely. A cable connector for differential transmission (a differential transmission cable connector) has a plug provided to an end of a differential transmission cable and covered by a shield cover. The differential transmission cable connector is applied to the differential transmission method, and is used, for instance, to connect a computer and a server.

FIGS. 1 and 2 are an exploded perspective view and a sectional view, respectively, of a conventional differential transmission cable connector 10. In FIGS. 1 and 2, X1–X2, Y1–Y2, and Z1–Z2 indicate the directions of width, length, and height, respectively, of the differential transmission cable connector 10.

FIG. 3 is a sectional view of a differential transmission cable 20. Referring to FIG. 3, the differential transmission cable 20 includes multiple pair wires 21 inside a tube of a double-covering structure formed of an outer cover 27 and a braided shield 28. Each pair wire 21 includes paired first and second covered signal wires 22-1 and 22-2 for differential signal transmission and a drain wire 25, which are bundled with a metal tape wound spirally therearound. As shown in FIG. 6, the first and second covered signal wires 22-1 and 22-2 and the drain wire 25 extend from an end of the pair wire 21. The ends of the first and second covered signal wires 22-1 and 22-2 are processed so that first and second signal wires 23-1 and 23-2, respectively, are bared and exposed. The first and second signal wires 23-1 and 23-2 form a pair line.

Referring to FIGS. 1 and 2, in the differential transmission cable connector 10, the first and second signal wires 23-1 and 23-2 and the drain wire 25 extending from each of the multiple pair wires 21 extending from the end of the differential transmission cable 20 are connected by soldering to the corresponding Y1-side terminals of a relay board 12, which is fixed to the Y1 side of a contact assembly 11. Shield covers 31 and 32 cover the contact assembly 11, the relay board 12, and the end portion of the differential transmission cable 20. In the differential transmission cable connector 10, the contact assembly 11, the relay board 12, and the end portion of the differential transmission cable 20 form a data transmission channel.

Japanese Laid-Open Patent Application No. 2003-059593 discloses a conventional cable connector for differential transmission.

Focusing on the shield between adjacent data transmission channels, the differential transmission cable connector 10 has a problem in the part of the relay board 12. On both the upper and lower surfaces of the relay board 12, wiring patterns extending along the Y-axis are formed side by side along the X-axis. The vertically aligned upper and lower wiring patterns form a wiring pattern pair so that the wiring pattern pairs are formed side by side along the X-axis on the relay board 12. Accordingly, for structural reasons, it is difficult to provide as good a shield between each two adjacent wiring pattern pairs as in the contact assembly 11.

In these years, signals processed by computers and servers have become higher in speed, so that adverse effects on transmission characteristics due to low shielding provided by the relay board 12 have become unignorable.

Further, in terms of production costs, it is required that differential transmission cable connectors be structured so that they can be assembled with efficiency with good productivity.

SUMMARY OF THE INVENTION

Accordingly, it is a general object of the present invention to provide a differential transmission cable connector in which the above-described disadvantages are eliminated.

A more specific object of the present invention is to provide a differential transmission cable connector improved in high-speed signal transmission characteristics.

The above objects of the present invention are achieved by a cable connector for differential transmission, including: a contact assembly including an electrically insulating block body in which signal contact pairs and ground contacts are incorporated to be arranged side by side alternately, the signal contact pairs each being formed of first and second signal contacts, the first signal contact having a first signal wire connection part thereof projecting from a surface of the block body, the second signal contact having a second signal wire connection part thereof projecting from the surface of the block body, the ground contacts each having a drain wire connection part thereof projecting from the surface of the block body; and an alignment member including a signal wire alignment part and a joining part joined to the contact assembly, the signal wire alignment part being configured to align first signal wires and second signal wires extending from an end of a differential transmission cable so that the first and second signal wires are arranged in positions corresponding to the first and second signal wire connection parts, respectively, wherein the alignment member is joined to the contact assembly through the joining part on a side of the surface of the block body, the differential transmission cable includes a plurality of pair wires each formed of a corresponding one of the first signal wires, a corresponding one of the second signal wires, and a drain wire, the first and second signal wires are connected to the first and second signal wire connection parts, respectively, and the drain wires are connected to the drain wire connection parts.

The above objects of the present invention are also achieved by a cable connector for differential transmission, including: a contact assembly including an electrically insulating block body in which signal contact pairs and ground contacts are incorporated to be arranged side by side alternately, the signal contact pairs each being formed of first and second signal contacts, the first signal contact having a first signal wire connection part thereof projecting from a surface of the block body, the second signal contact having a second signal wire connection part thereof projecting from the surface of the block body, the ground contacts each having a drain wire connection part thereof projecting from the surface of the block body; and an alignment member including a pair wire alignment part and a joining part joined to the contact assembly, the pair wire alignment part being configured to align a plurality of pair wires included in a differential transmission cable in a direction in which the signal contact pairs and the ground contacts are arranged side by side alternately, wherein the alignment member is joined to the contact assembly through the joining part on a side of the surface of the block body, each of the pair wires is formed of a first signal wire, a second signal wire, and a drain wire, the first and second signal wires are connected to the first and second signal wire connection parts, respectively, and the drain wires are connected to the drain wire connection parts.

The above objects of the present invention are also achieved by a cable connector for differential transmission, including: a contact assembly including an electrically insulating block body in which signal contact pairs and ground contacts are incorporated to be arranged side by side alternately, the signal contact pairs each being formed of first and second signal contacts, the first signal contact having a first signal wire connection part thereof projecting from a surface of the block body, the second signal contact having a second signal wire connection part thereof projecting from the surface of the block body, the ground contacts each having a drain wire connection part thereof projecting from the surface of the block body; and an alignment member including a pair wire alignment part, a signal wire alignment part, and a joining part joined to the contact assembly, the pair wire alignment part being configured to align a plurality of pair wires included in a differential transmission cable in a direction in which the signal contact pairs and the ground contacts are arranged side by side alternately, the pair wires each being formed of a first signal wire, a second signal wire, and a drain wire, the signal wire alignment part being configured to align the first and second signal wires extending from an end of the differential transmission cable so that the first and second signal wires are arranged in positions corresponding to the first and second signal wire connection parts, respectively, wherein the alignment member is joined to the contact assembly through the joining part on a side of the surface of the block body, the first and second signal wires are connected to the first and second signal wire connection parts, respectively, and the drain wires are connected to the drain wire connection parts.

According to the present invention, the first and second signal wires and the drain wires of the differential transmission cable are directly connected to the first and second signal contacts and the ground contacts, respectively, of the contact assembly. Further, the rear ends of the ground contacts extend further in the rear direction than those of the first and second signal contacts. Accordingly, a better shield is provided between a differential signal transmission channel and another differential signal transmission channel adjacent thereto, thus resulting in better transmission characteristics. Therefore, the above-described differential transmission cable connectors are employable for a high-speed signal transmission channel.

Further, the alignment member, aligning the pair wires and the first and second signal wires to the contact assembly, is joined to the contact assembly, thereby forming a differential transmission cable connector temporary assembly. Since electric welding is performed with respect to the temporary assembly, the welding of the first and second signal wires to the first and second signal contacts and the welding of the drain wires to the ground contacts can be performed with good operability.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given below, with reference to the accompanying drawings, of an embodiment of the present invention.

Figure 4:
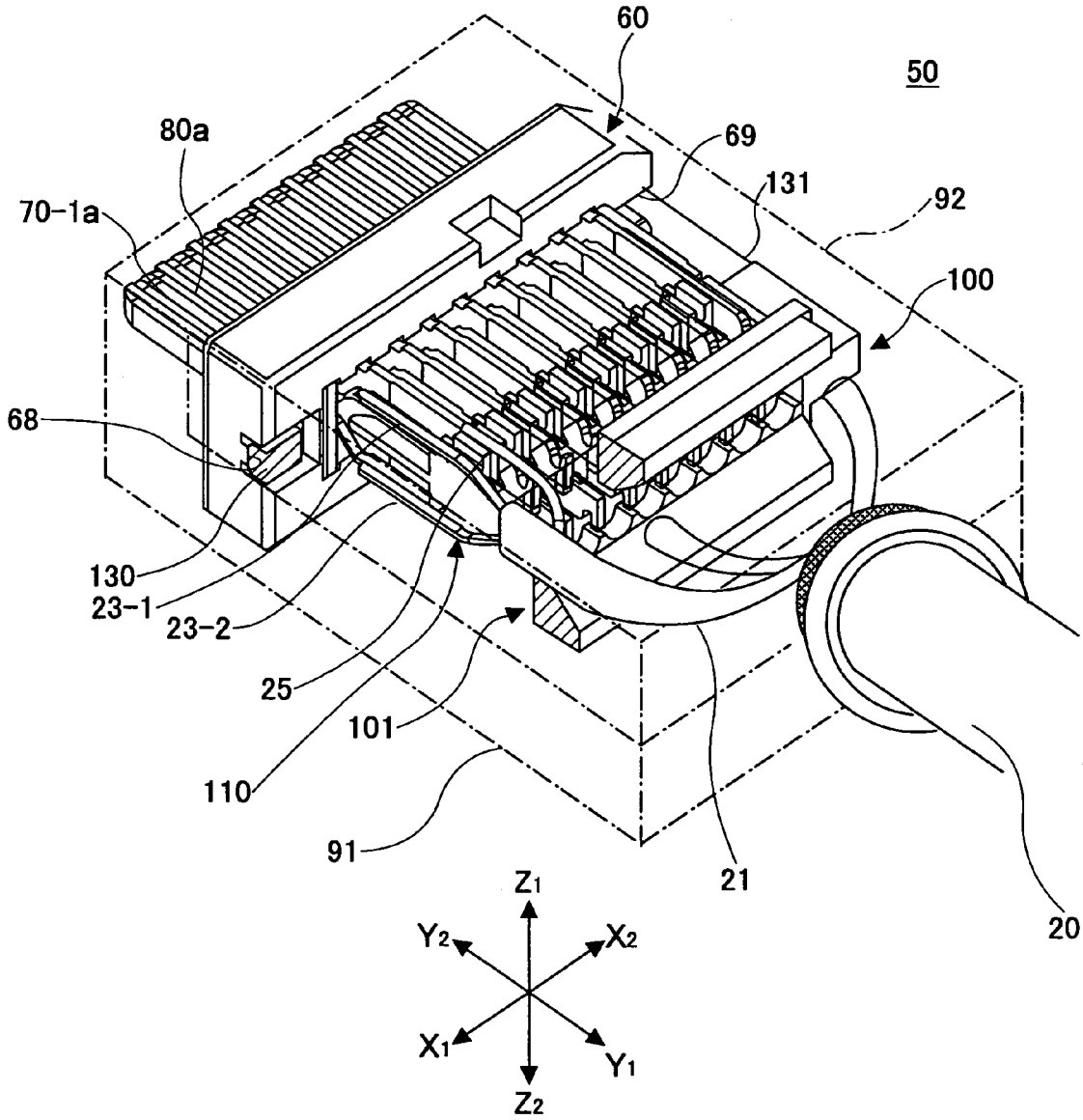
FIG. 4 is a perspective view of a differential transmission cable connector according to an embodiment of the present invention.
Figure 5:
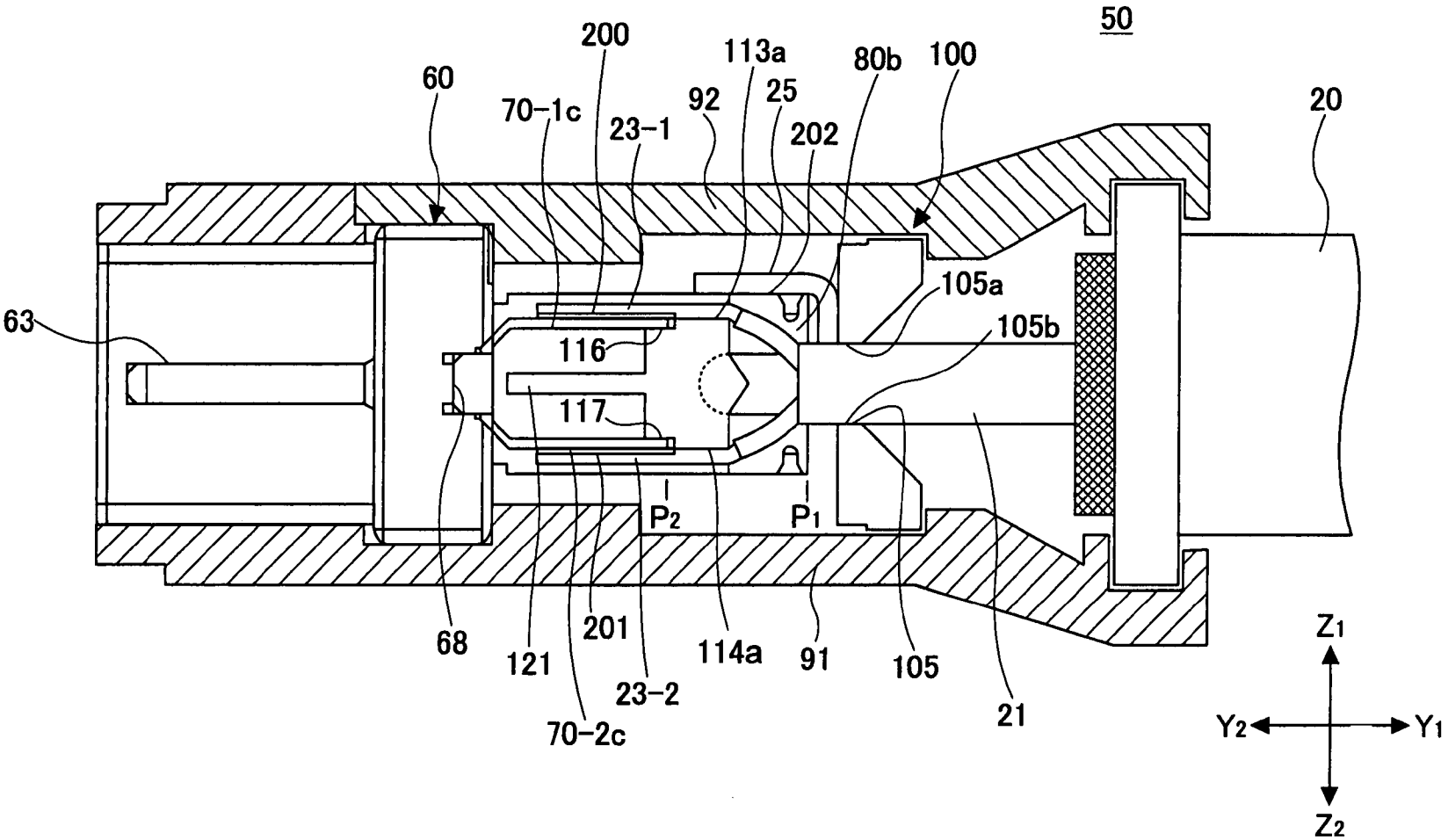
FIG. 5 is a sectional view of the differential transmission cable connector according to the embodiment of the present invention.
Figure 6:
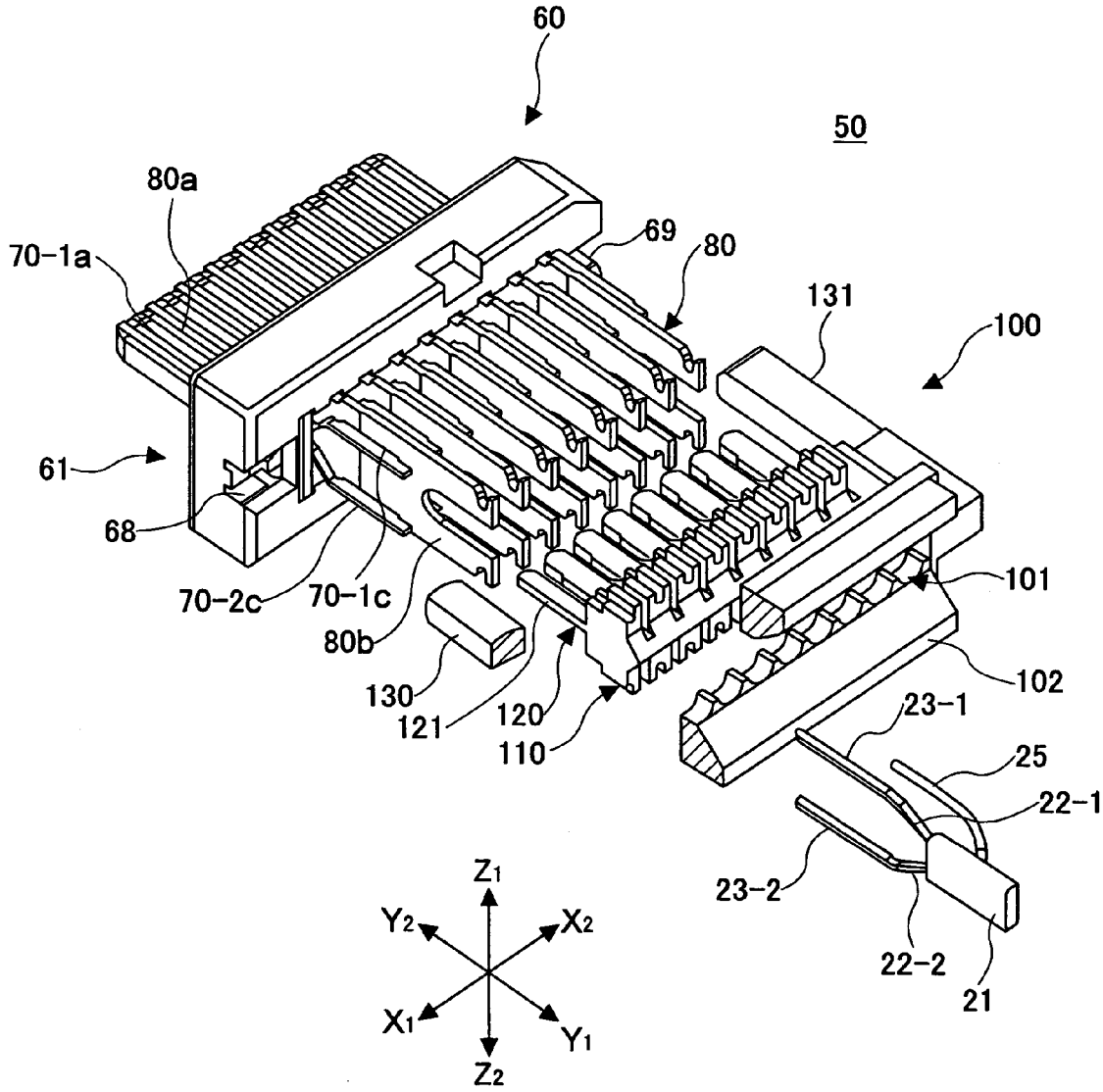
FIG. 6 is an exploded perspective view of the differential transmission cable connector according to the embodiment of the present invention.

FIGS. 4, 5 and 6 are a perspective view, a sectional view, and an exploded perspective view, respectively, of a differential transmission cable connector 50 according to the embodiment of the present invention. In the following drawings, $X_1$–$X_2$, $Y_1$–$Y_2$, and $Z_1$–$Z_2$ indicate the directions of width, length, and height, respectively, of the differential transmission cable connector 50. The differential transmission cable connector 50 has its front side in the $Y_2$ direction and its rear side in the $Y_1$ direction.

Figure 1:
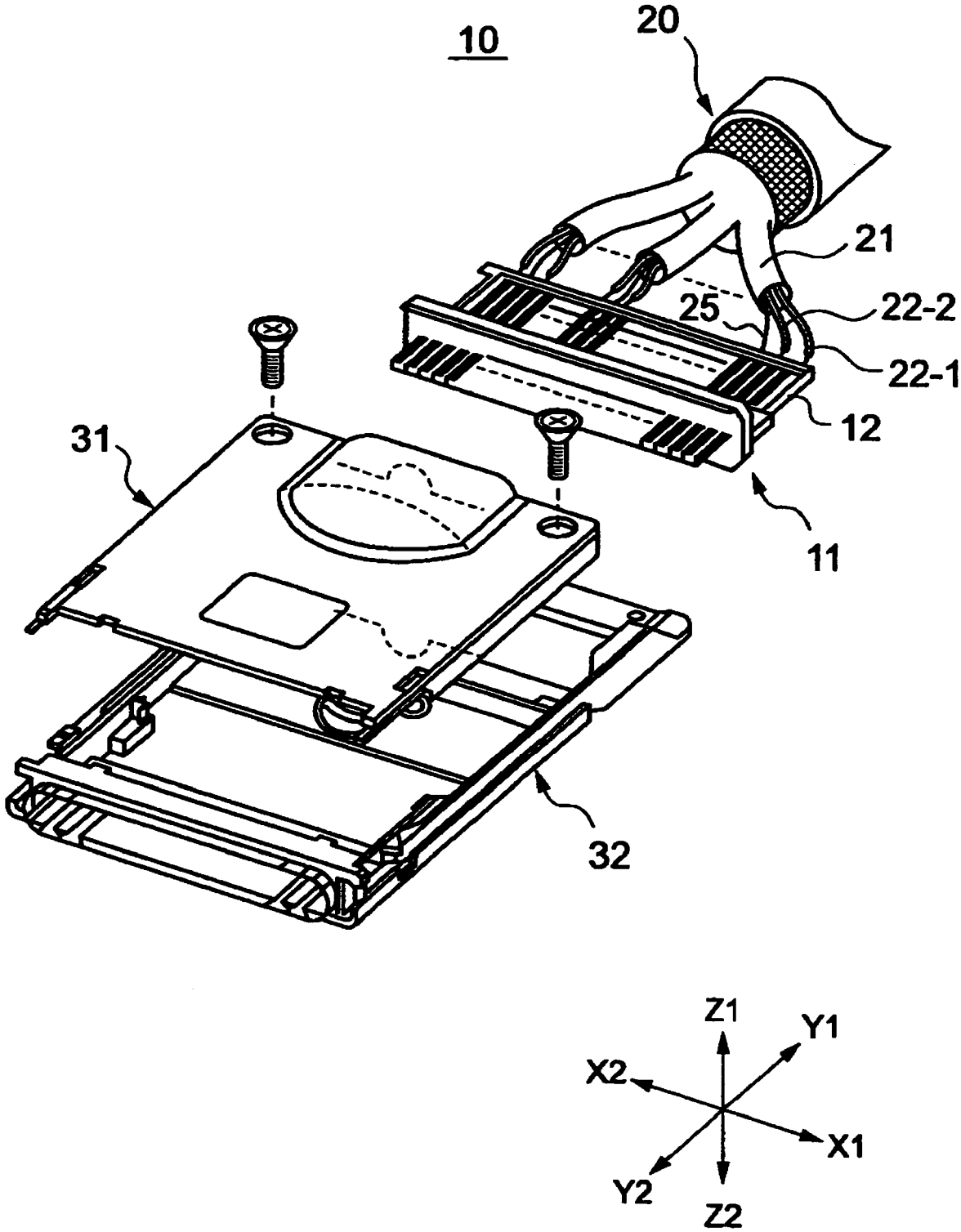
FIG.1 PRIOR ART
FIG. 1 is an exploded perspective view of a conventional differential transmission cable connector.
Figure 2:
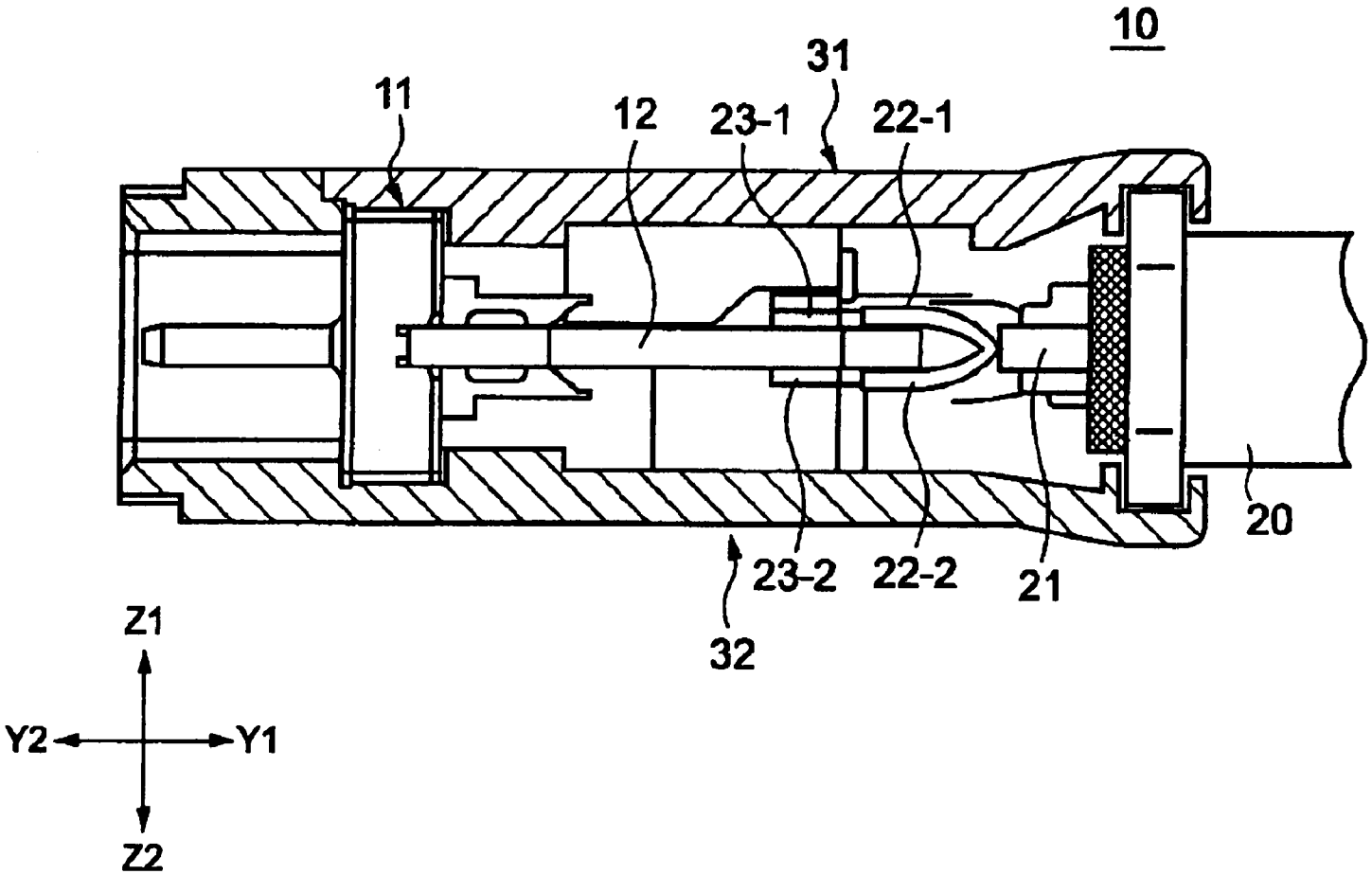
FIG.2 PRIOR ART
FIG. 2 is a sectional view of the conventional differential transmission cable connector.
Figure 3:
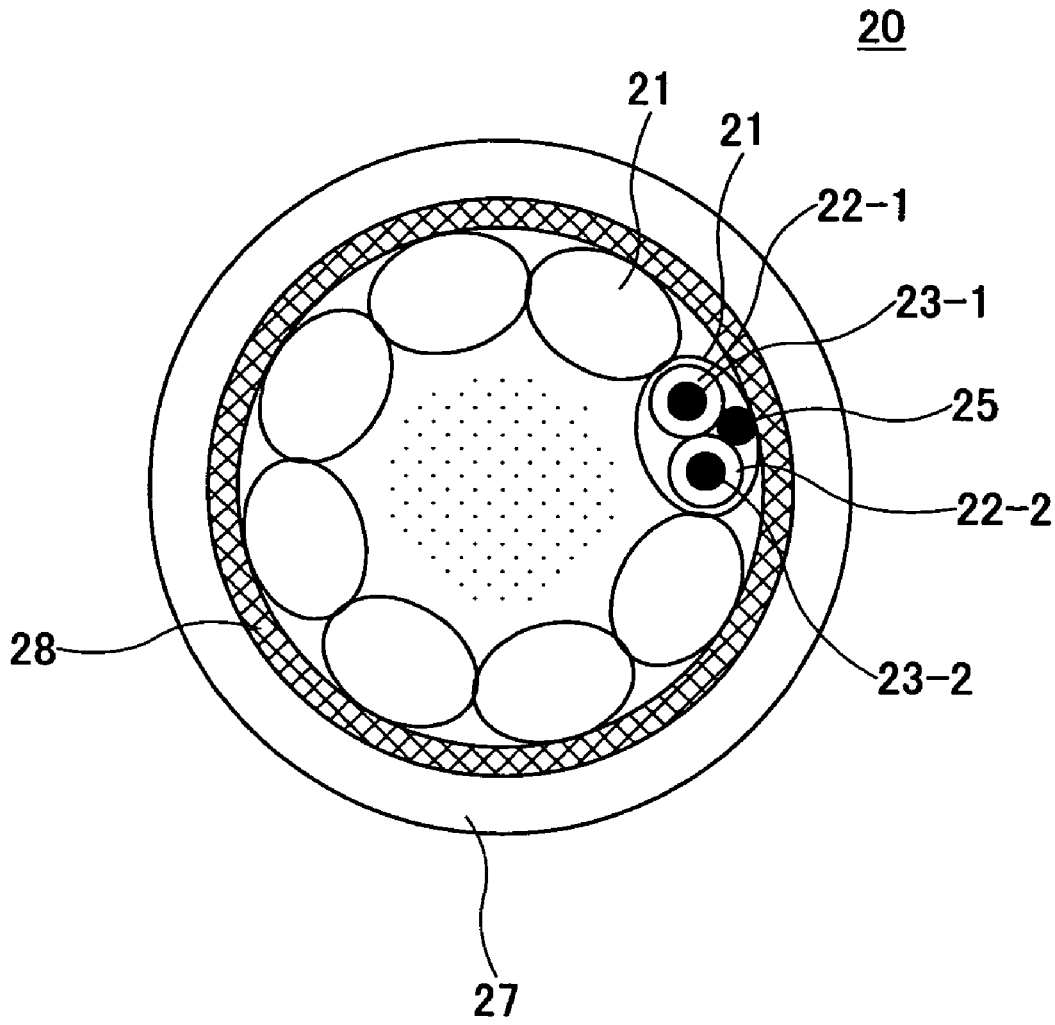
FIG.3 PRIOR ART
FIG. 3 is a sectional view of a differential transmission cable.
Figure 7:
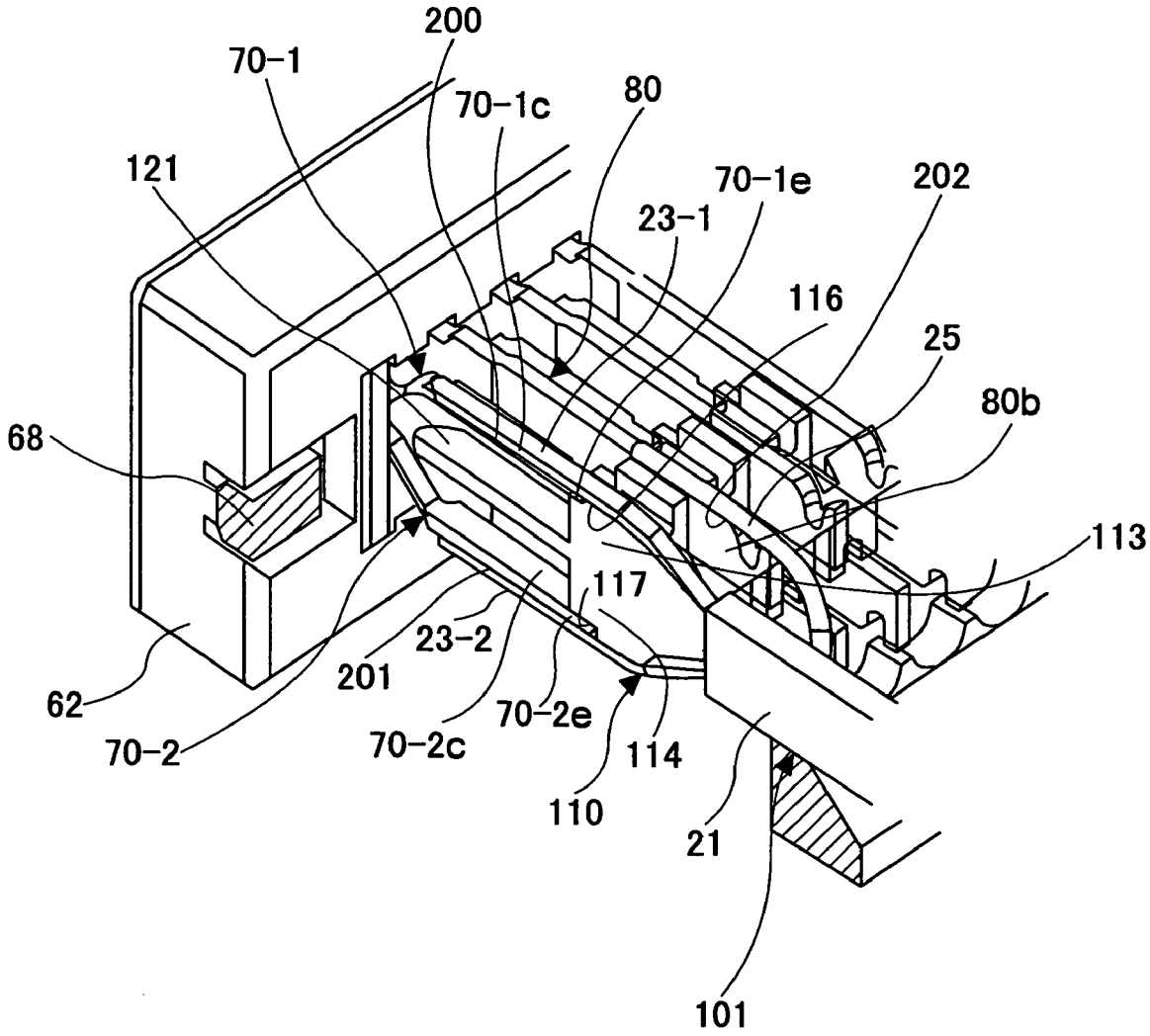
FIG. 7 is an enlarged view of part of the differential transmission cable connector where wires and contacts are connected by welding according to the embodiment of the present invention.

Schematically, the differential transmission cable connector 50 has a structure formed by removing the relay board 12 from the differential transmission cable connector 10 shown in FIGS. 1 and 2. The end of the differential transmission cable 20 is connected directly to a contact assembly 60 by welding. Shield covers 91 and 92 cover the contact assembly 60, an alignment member 100, and the end portion of the differential transmission cable 20. Signal pairs and grounds are arranged alternately along the X-axis so that a shield is provided between each two adjacent signal pairs. The contact assembly 60 functions as a plug. The differential transmission cable connector 50 is a plug-side connector. The differential transmission cable 20 is the same as shown in FIG. 3. FIG. 7 is an enlarged view of part of the differential transmission cable connector 50 where the first and second signal wires 23-1 and 23-2, aligned by the alignment member 100, are welded to corresponding signal contacts 70-1 and 70-2, respectively, and the drain wires 25 are welded to corresponding ground contacts 80. Reference numerals 200, 201, and 202 denote welded parts. The alignment and the welding are described below.

Figure 8A:
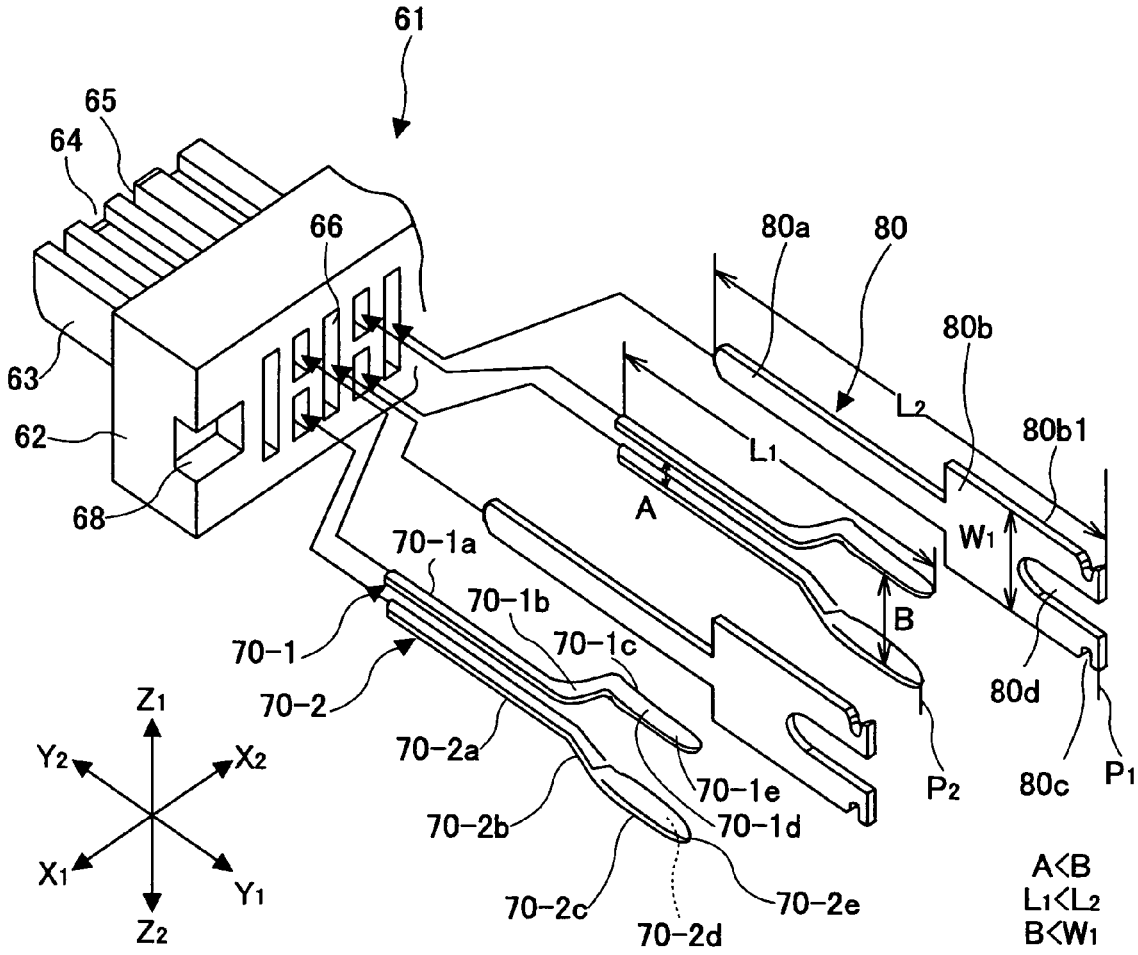
FIG. 8A is an exploded perspective view of part of a contact assembly.

Next, a description is given of the contact assembly 60 included in the differential transmission cable connector 50. FIG. 8A is an exploded perspective view of part of the contact assembly 60. Referring to FIG. 8A, signal contact pairs, formed of the corresponding first and second signal contacts 70-1 and 70-2 aligned along the Z-axis, and the ground contacts 80 are incorporated in a block body 61, arranged alternately along the X-axis with a predetermined pitch, so that the contact assembly 60 is formed. The block body 61 is an electrically insulating synthetic resin molded component. The block body 61 includes a base part 62 and a plate-like projection part 63. Multiple grooves 64 and slits 65 are formed in the projection part 63, and multiple tunnels 66 are formed in the base part 62. The first and second signal contacts 70-1 and 70-2 and the ground contacts 80 are press-fitted into the block body 61 in the $Y_2$ direction from its $Y_1$ side. Recesses (fitting parts) 68 and 69 (FIGS. 4 and 6, for instance) are formed on the $X_1$ and $X_2$ sides, respectively, on the $Y_1$-side face of the base part 62. Arm parts 130 and 131 of the alignment member 100 have their ends fitted into the recesses 68 and 69, respectively.

Figure 8B:
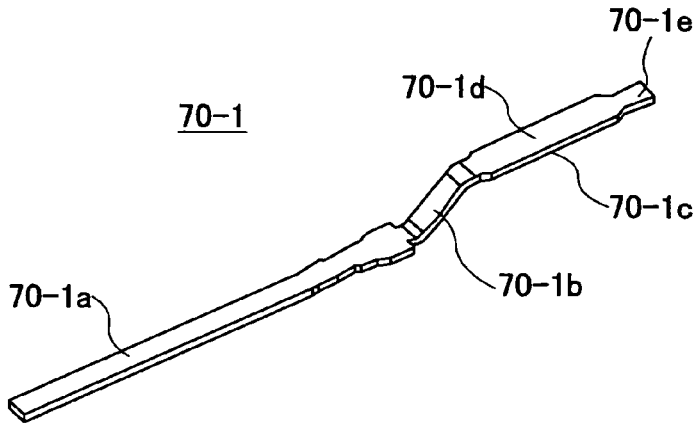
FIG. 8B is a perspective view of a first signal contact according to the embodiment of the present invention.

FIG. 8B is a perspective view of the first signal contact 70-1. Referring to FIGS. 8A and 8B, the first signal contact 70-1 has an extremely thin, narrow plate-like shape including a bent portion. The first signal contact 70-1 includes a contact part 70-1*a* on the $Y_2$ side, an angled intermediate part 70-1*b* in the middle, and a first signal wire connection beam part 70-1*c* on the $Y_1$ side. The beam part 70-1*c* serves as a part for connecting the first signal wire 23-1. The first signal contact 70-1 has a length $L_1$. The shape of the second signal contact 70-2 is a mirror image of that of the first signal contact 70-1 with respect to the Y-axis. The second signal contact 70-2 includes a contact part 70-2*a*, an intermediate part 70-2*b*, and a second signal wire connection beam part 70-2*c* serving as a part for connecting the second signal wire 23-2. The first and second signal contacts 70-1 and 70-2 have their respective contact parts 70-1*a* and 70-2*a* press-fitted into the block body 61 so that their respective intermediate parts 70-1*b* and 70-2*b* and beam parts 70-1*c* and 70-2*c* project from the block body 61 in the $Y_1$ direction so as to widen the distance between the first and second signal contacts 70-1 and 70-2 in the $Z_1$ and $Z_2$ directions. Each of an upper ($Z_1$) surface 70-1*d* of the beam part 70-1*c* and a lower ($Z_2$) surface 70-2*d* of the beam part 70-2*c* is an X-Y plane. The distance along the Z-axis between the contact parts 70-1*a* and 70-2*a* is A, and the distance along the Z-axis between the beam parts 70-1*c* and 70-2*c* is B, which is greater than A (FIG. 8A).

Referring to FIG. 8A, the ground contact 80 has a plate-like shape. The ground contact 80 has a length L2 that is considerably greater than the length L1 of each of the first and second signal contacts 70-1 and 70-2. The ground contact 80 includes a shield part 80*a* on the $Y_2$ side and a projecting shield part 80*b* on the $Y_1$ side. The shield part 80*a* is press-fitted into the block body 61, so that the projecting shield part 80*b* projects from the block body 61 in the $Y_1$ direction. The projecting shield part 80*b* has a $Z_1$–$Z_2$ dimension or width $W_1$, which is sufficiently greater than the distance B between the beam parts 70-1*c* and 70-2*c*. The Y1-side end $P_1$ of the projecting shield part 80*b* is positioned significantly further in the $Y_1$ direction from the block body 61 than the end $P_2$ of each of the beam parts 70-1*c* and 70-2*c*. Accordingly, each two adjacent signal contact pairs arranged along the X-axis, each formed of the first and second signal contacts 70-1 and 70-2, are shielded from each other by the corresponding ground contact 80 interposed therebetween. Particularly, the projection of the projecting shield part 80*b* in each of the $X_1$ and $X_2$ directions covers the intermediate parts 70-1*b* and 70-2*b*, the beam parts 70-1*c* and 70-2*c*, and further, the first and second signal wires 23-1 and 23-2 connected thereto. As a result, the projecting shield part 80*b* provides a shield between the intermediate parts 70-1*b* adjacent along the X-axis, between the intermediate parts 70-1*b* adjacent along the X-axis, between the beam parts 70-1*c* adjacent along the X-axis, between the beam parts 70-2*c* adjacent along the X-axis, between the first signal wires 23-1 adjacent along the X-axis, and between the second signal wires 23-2 adjacent along the X-axis.

A $Z_1$-side end surface part 80*b*1 of the projecting shield part 80*b* is connected to the corresponding drain wire 85. Further, the projecting shield part 80*b* has hook parts 80*c* and a cutout part 80*d* formed therein on the side of its end $P_1$. The hook parts 80*c* are provided for a jig for press-fitting the ground contact 80. A below-described horizontal part 118 (FIGS. 10, 11A and 11B) of the alignment member 100 is fitted into the cutout part 80*d*.

On the $Y_1$ side of the contact assembly 60, the beam parts 70-1*c* and the beam parts 70-2*c* are aligned in two respective rows along the X-axis, and the pairs of the beam parts 70-1*c* and 70-2*c* and the projecting shield parts 80*b* are aligned, arranged alternately along the X-axis.

Figure 9A:
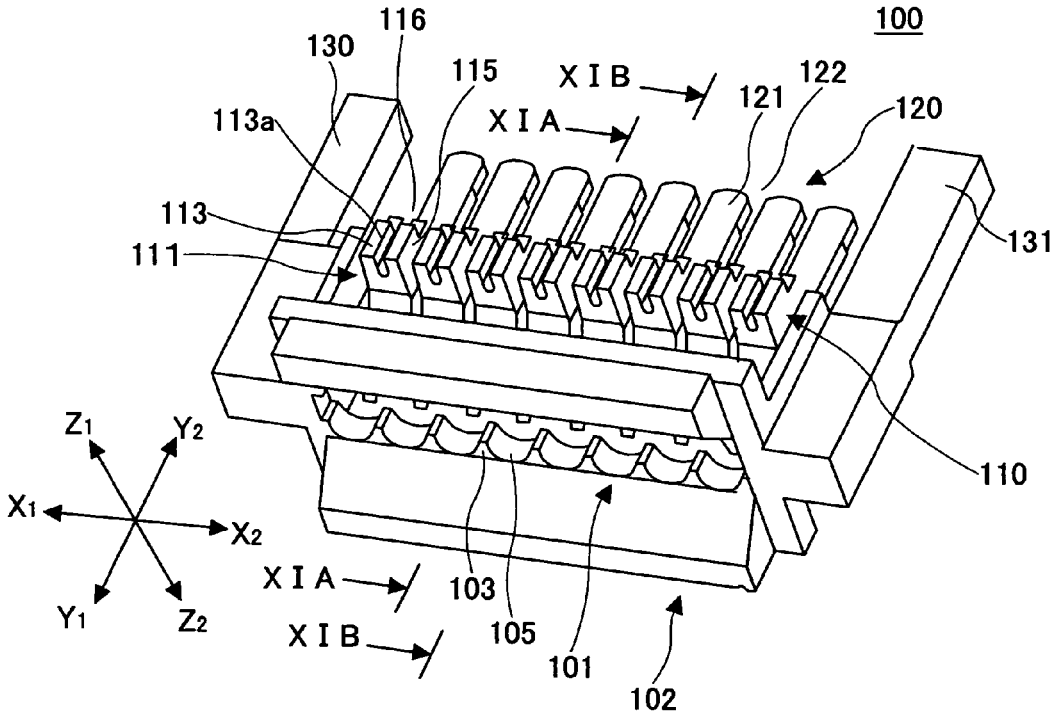
FIGS. 9A and 9B are perspective views of an alignment member according to the embodiment of the present invention.
Figure 9B:
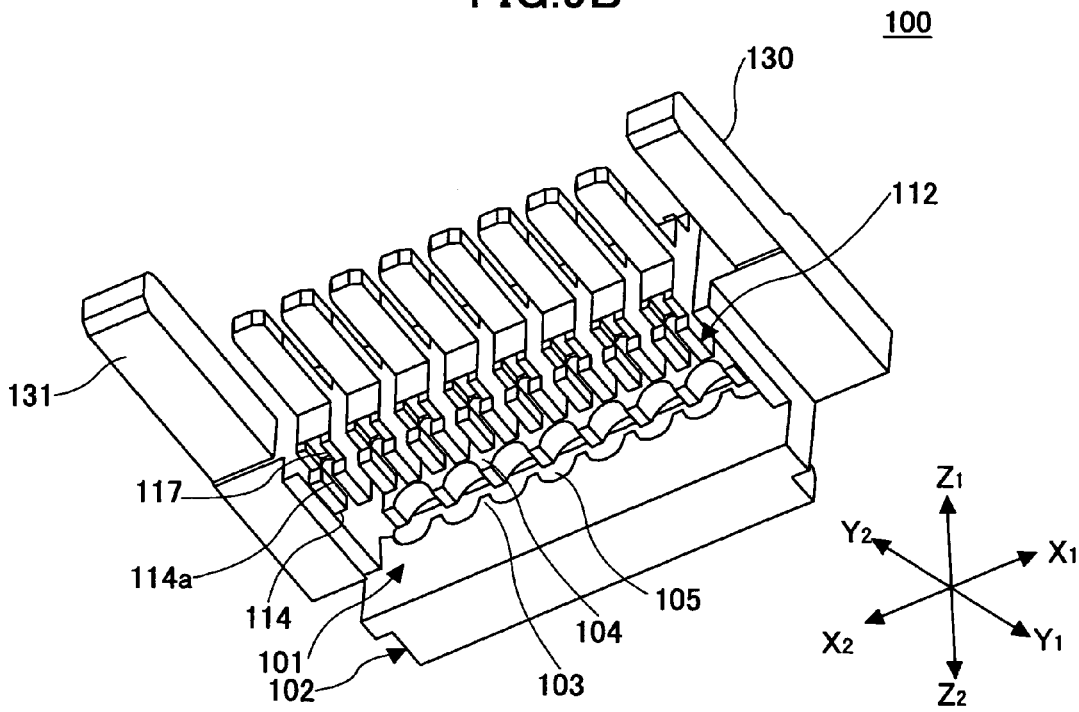
Figure 10:
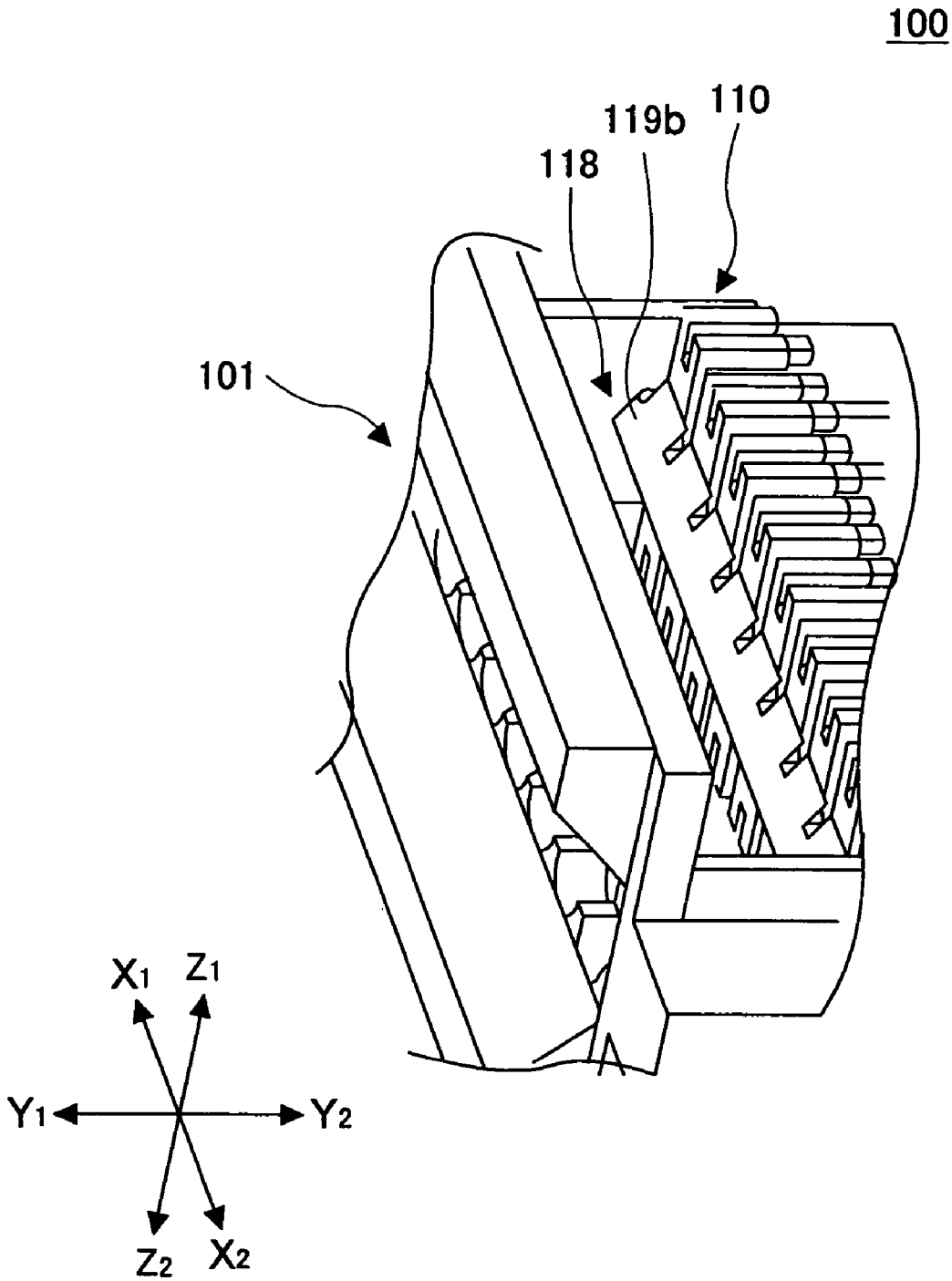
FIG. 10 is a perspective view of part of the alignment member according to the embodiment of the present invention.
Figure 11A:
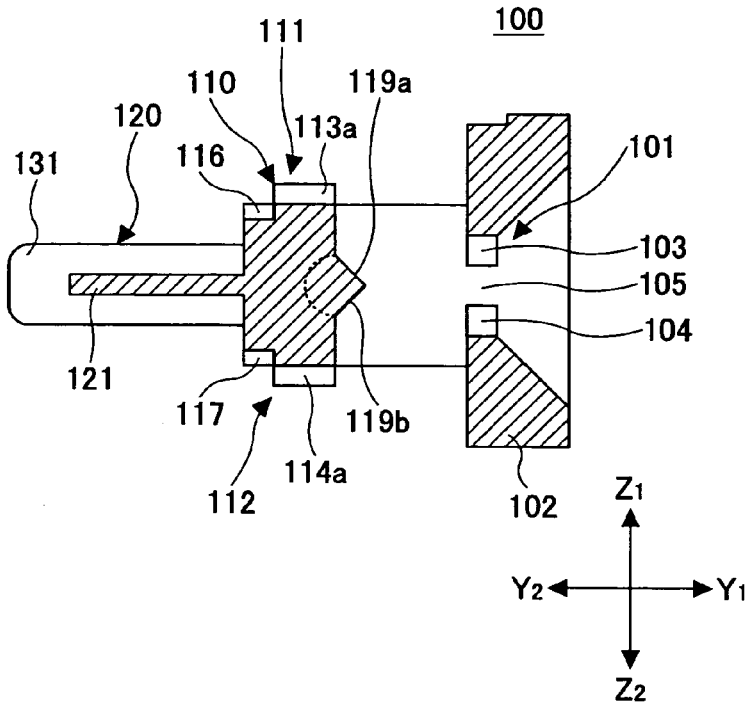
FIG. 11A is a sectional view of the alignment member taken along a Y-Z plane including the line XIA—XIA of FIG. 9A.
Figure 11B:
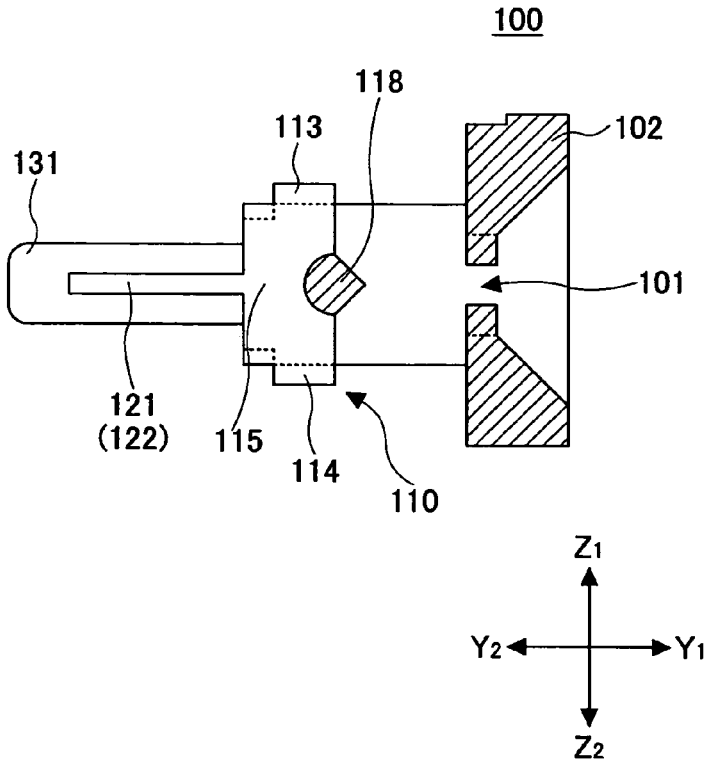
FIG. 11B is a sectional view of the alignment member taken along a Y-Z plane including the line XIB—XIB of FIG. 9A according to the embodiment of the present invention.

Next, a description is given of the alignment member 100 included in the differential transmission cable connector 50. FIGS. 9A and 9B are perspective views of the alignment member 100. FIG. 10 is a perspective view of part of the alignment member 100. FIG. 11A is a sectional view of the alignment member 100 taken along a Y-Z plane including the line XIA—XIA of FIG. 9A, the Y-Z plane passing through paired U-shaped groove 113*a* and 114*a*. FIG. 11B is a sectional view of the alignment member 100 taken along a Y-Z plane including the line XIB—XIB of FIG. 9A, the Y-Z plane passing through a slit 115. The alignment member 100 aligns the first and second signal wires 23-1 and 23-2 extending irregularly from the end of the differential transmission cable 20 so that the first and second signal wires 23-1 and 23-2 are arranged in positions corresponding to the aligned beam parts 70-1*c* and 70-2*c*, respectively, of the contact assembly 60. Further, the alignment member 100 maintains the first and second signal wires 23-1 and 23-2 in the above-described aligned state. The alignment member 100 is joined to the contact assembly 60 to be positioned with respect to the contact assembly 60.

The alignment member 100, which is a synthetic resin molded component, includes a pair wire alignment part 101 on the $Y_1$ side. The pair wire alignment part 101 separates each two adjacent pair wires 21 so that the pair wires 21 are arranged along the X-axis with a predetermined pitch. The alignment member 100 also includes a signal wire alignment part 110 on the $Y_2$ side of the pair wire alignment part 101. The signal wire alignment part 110 aligns the first and second signal wires 23-1 and 23-2 so that the first signal wires 23-1 are separated from the second signal wires 23-2 along the Z-axis. The alignment member 100 also includes a comb teeth part 120 extending from the signal wire alignment part 110 in the $Y_2$ direction. The alignment member 100 further includes the arm parts 130 and 131 extending from the $X_1$ side and $X_2$ side, respectively, of the pair wire alignment part 101 and the signal wire alignment part 110 in the $Y_2$ direction. From a structural point of view, the main body of the alignment member 100 is a rectangular frame body 102 elongated along the X-axis. The pair wire alignment part 101 is provided inside the frame body 102. The arm parts 130 and 131, serving as connecting parts, extend from the $X_1$ side and $X_2$ side, respectively, of the frame body 102. The signal wire alignment part 110 is provided to extend along the X-axis between intermediate portions of the arm parts 130 and 131.

The pair wire alignment part 101 includes tunnels 105 arranged along the X-axis, the tunnels 105 each holding a corresponding one of the pair wires 21. Specifically, U-shaped partition walls 103 and inverse U-shaped partition walls 104, opposing each other along the Z-axis, are arranged along the X-axis so that the elliptic tunnels 105, each elongated along the Z-axis, are formed to be arranged along the X-axis, communicating with one another at their center portions.

The signal wire alignment part 110 includes a $Z_1$-side first signal wire alignment part 111 and a $Z_2$-side second signal wire alignment part 112. The first signal wire alignment part 111 includes U-shaped grooves 113*a* arranged along the X-axis, the U-shaped grooves 113*a* each holding a corresponding one of the first signal wires 23-1. The second signal wire alignment part 112 includes U-shaped grooves 114*a* arranged along the X-axis, the U-shaped grooves 114*a* each holding a corresponding one of the second signal wires 23-2. Specifically, the first signal wire alignment part 111 includes U-shaped parts 113 arranged at intervals along the X-axis, and the second signal wire alignment part 112 includes U-shaped parts 114 arranged at intervals along the X-axis. The U-shaped parts 113 and 114 include the U-shaped grooves 113*a* and 114*a*, respectively. The slit 115 is formed between each two adjacent U-shaped parts 113 and between the corresponding adjacent U-shaped parts 114. The slits 115 receive the corresponding projecting shield parts 80*b*. Referring to FIG. 5, each U-shaped groove 113*a* is positioned higher, or further in the $Z_1$ direction, along the Z-axis than a $Z_1$-side end 105*a* of each elliptic tunnel 105, and each U-shaped groove 114*a* is positioned lower, or further in the $Z_2$ direction, along the Z-axis than a $Z_2$-side end 105*b* of each elliptic tunnel 105.

Referring to FIGS. 5, 9A, 9B and 11A, groove-like beam support parts 116 and 117 are formed on the Y2 side in the signal wire alignment part 110. Each beam support part 116 supports an end portion 70-1*e* (FIGS. 8A and 8B) of the corresponding beam part 70-1*c*. Each beam support part 116 is provided on the immediate $Y_2$ side of the corresponding U-shaped part 113 so as to be substantially aligned therewith. Each beam support part 117 supports an end portion 70-2*e* (FIG. 8A) of the corresponding beam part 70-2*c*. Each beam support part 117 is provided on the immediate $Y_2$ side of the corresponding U-shaped part 114 so as to be substantially aligned therewith. As shown in FIG. 11A, there is a vertical distance between the positions of the beam support part 116 and the U-shaped groove 113*a* along the Z-axis. The distance corresponds to the thickness of the beam part 70-1*c*. There is also a vertical distance between the positions of the beam support part 117 and the U-shaped groove 114*a* along the Z-axis. The distance corresponds to the thickness of the beam part 70-2*c*.

As shown in FIGS. 10, 11A, and 11B, the horizontal part 118 is provided on the $Y_1$ side of the signal wire alignment part 110 so as to extend along the X-axis between the arm parts 130 and 131. The U-shaped parts 113 and 114 project from the horizontal part 118 in the $Y_2$ direction. The horizontal part 118 is shaped like a triangular prism having a vertical angle on the $Y_1$ side. The horizontal part 118 includes slopes 119*a* and 119*b* serving as guide parts. When the first and second signal wires 23-1 and 23-2 move in the $Y_2$ direction from the $Y_1$ side, the slope 119*a* guides the end of each first signal wire 23-1 toward the $Z_1$ direction, or the direction of the corresponding U-shaped groove 113*a*, and the slope 119*b* guides the end of each second signal wire 23-2 toward the $Z_2$ direction, or the direction of the corresponding U-shaped groove 114*a*.

The comb teeth part 120 is a group of teeth 121 each projecting in the $Y_2$ direction from an intermediate position along the Z-axis between the corresponding U-shaped parts 113 and 114. Each tooth 121 is interposed between the corresponding beam parts 70-1*c* and 70-2*c* with the alignment member 100 being joined to the contact assembly 60. Thereby, the tooth 121 sets the impedance between the beam parts 70-1*c* and 70-2*c* to a predetermined value. Further, when a force is applied to bend the beam parts 70-1*c* and 70-2*c* in a direction to reduce the distance therebetween along the Z-axis, the tooth 121 receives the Y2-side portion of each of the intermediate parts 70-1*b* and 70-2*b* so as to prevent the beam parts 70-1*c* and 70-2*c* from being bent. A slit 122 is formed between each two adjacent teeth 121. The slits 122 are aligned with the corresponding slits 115 and connected thereto along the Y-axis. The slits 122 receive the projecting shield parts 80*b*.

The arm parts 130 and 131 are formed so that their ($Y_2$) ends are fitted into the recesses 68 and 69, respectively, of the base part 62 of the block body 61 included in the contact assembly 60.

Next, a description is given of the manufacturing process of the differential transmission cable connector 50.

The manufacturing, or assembling, process of the differential transmission cable connector 50 includes (a) an alignment process, (b) a joining process, and (c) a welding process.

(a) Alignment Process

Figure 12:
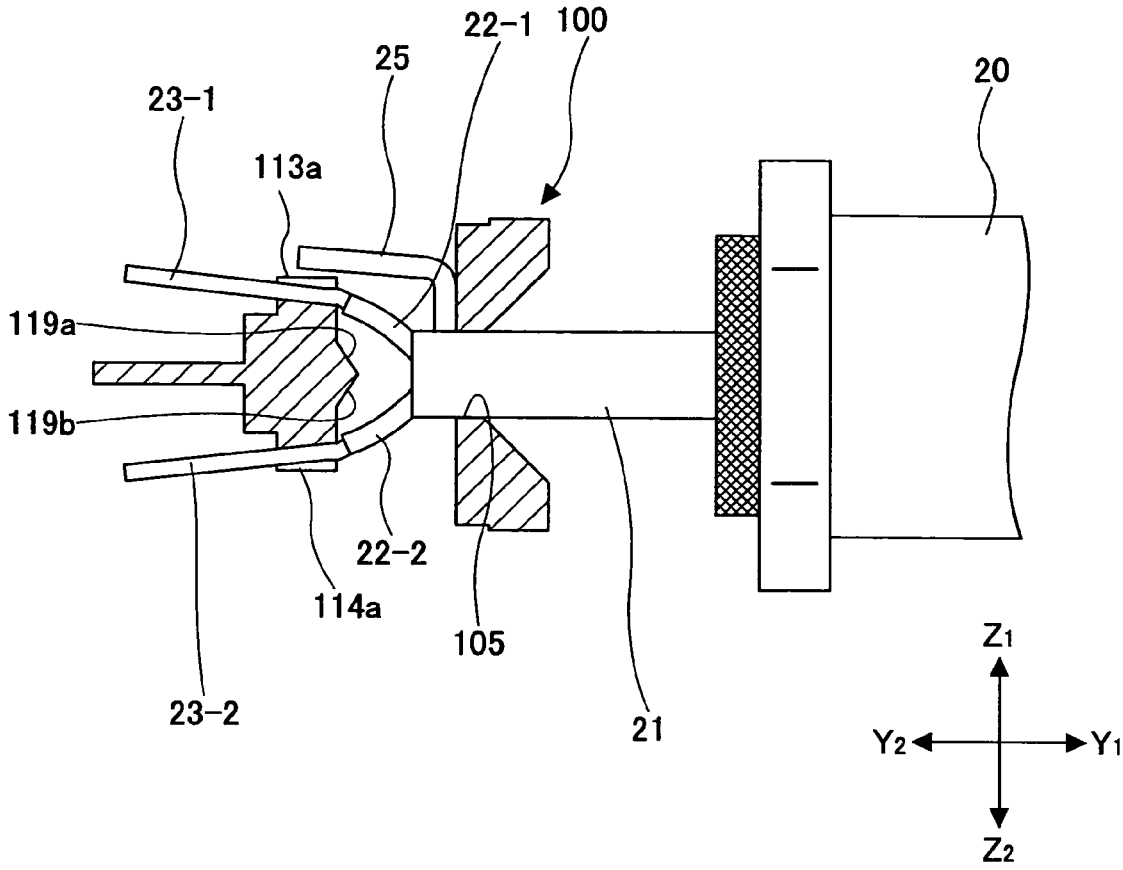
FIG. 12 is a diagram showing a state where the wires are aligned by the alignment member according to the embodiment of the present invention.
Figure 13:
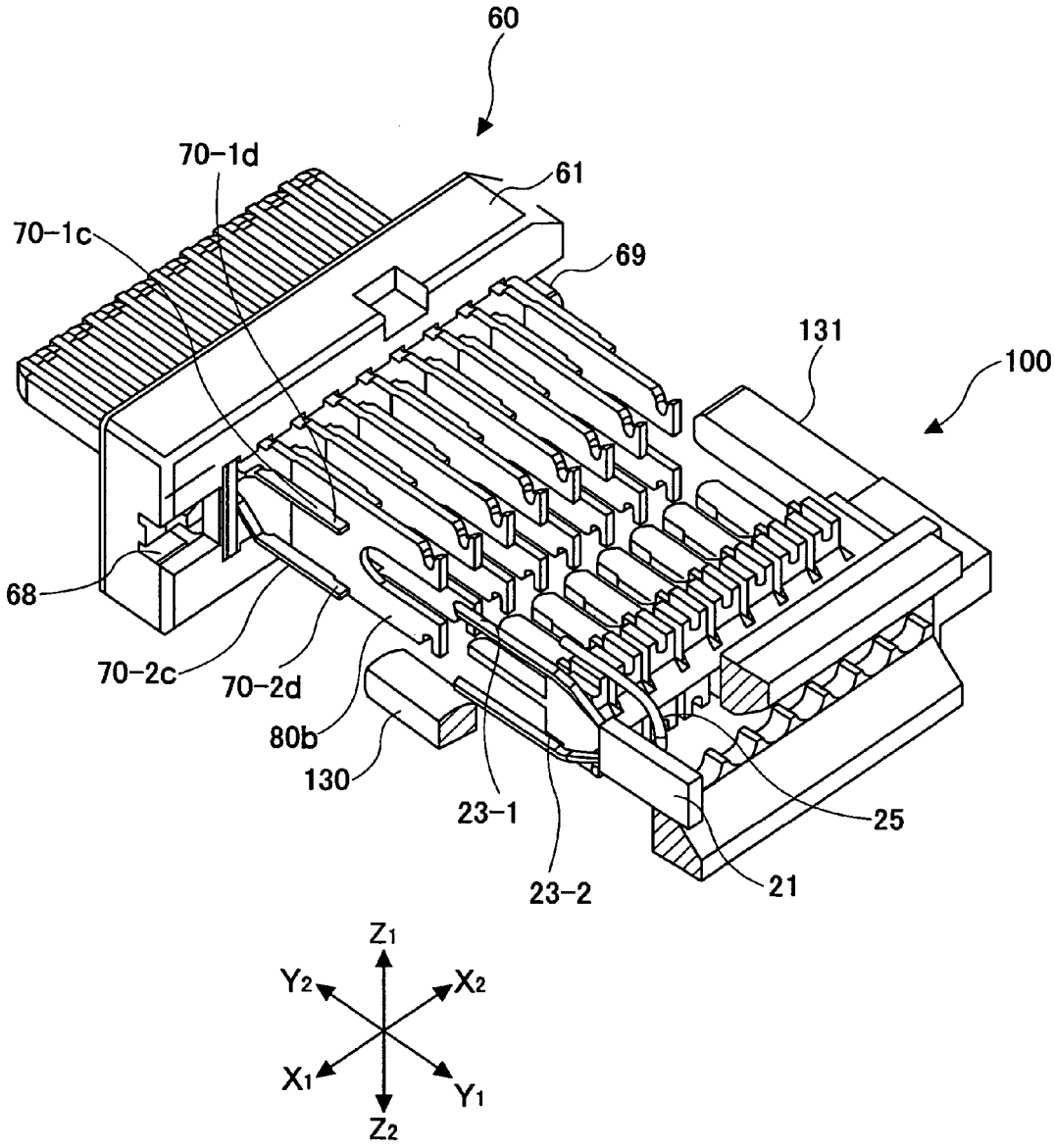
FIG. 13 is a diagram for illustrating the joining of the alignment member and the contact assembly according to the embodiment of the present invention.

As shown in FIGS. 12 and 13, the alignment member 100 is used so that the pair wires 21 extending irregularly from the end of the differential transmission cable 20 are aligned by the pair wire alignment part 101 with each pair wire 21 being specified by a number printed on its surface, and the first and second signal wires 23-1 and 23-2 extending from the end of each pair wire 21 are aligned by the signal wire alignment part 110.

In the alignment operation, the first and second signal wires 23-1 and 23-2 of each pair wire 21, whose end has been processed, are inserted into the alignment member 100 from the $Y_1$ side.

The end of each pair wire 21 is slightly pressed into an elliptic shape and inserted into the corresponding tunnel 105. As a result, the pair wire 21 is held and retained inside the tunnel 105.

The first signal wire 23-1 extending from the pair wire 21 is pushed into the corresponding U-shaped groove 113*a* to be held and retained therein, thus projecting in the Y2 direction. The second signal wire 23-2 is pushed into the corresponding U-shaped groove 114*a* to be held and retained therein, thus projecting in the Y2 direction. The distance between the first and second signal wires 23-1 and 23-2 along the Z-axis slightly widens toward the $Y_2$ direction.

The drain wire 25 is positioned on the immediate $X_1$ side of the aligned first and second signal wires 23-1 and 23-2, and is bent into an L-letter shape to be projecting in the $Y_2$ direction.

Thus, when one of the pair wires 21 is positioned, the next one of the pair wires 21 is positioned adjacently, so that the pair wires 21 are arranged adjacently to be aligned with one another. When the paired first and second signal wires 23-1 and 23-2 are aligned, the next paired first and second signal wires 23-1 and 23-2 are aligned in an adjacent position, so that the pairs of the aligned first and second signal wires 23-1 and 23-2 are arranged adjacently to be aligned with one another.

Accordingly, the pair wires 21 extending irregularly from the end of the differential transmission cable 20 are arranged to be aligned long the X-axis by the pair wire alignment part 101. Further, the first and second signal wires 23-1 and 23-2 extending from the ends of the pair wires 21 are arranged to be aligned along the Z-axis and the X-axis by the signal wire alignment part 110.

When each pair wire 21 is inserted into the alignment member 100 from the $Y_1$ side, the first and second signal wires 23-1 and 23-2 are guided by the slopes 119*a* and 119*b* toward the $Z_1$ and $Z_2$ directions to be positioned close to the U-shaped grooves 113*a* and 114*a*, respectively. Accordingly, the operation of pushing the first signal wire 23-1 into the U-shaped groove 113*a* and the operation of pushing the first signal wire 23-2 into the U-shaped groove 114*a* are performed with good operability.

(b) Joining Process

Figure 14:
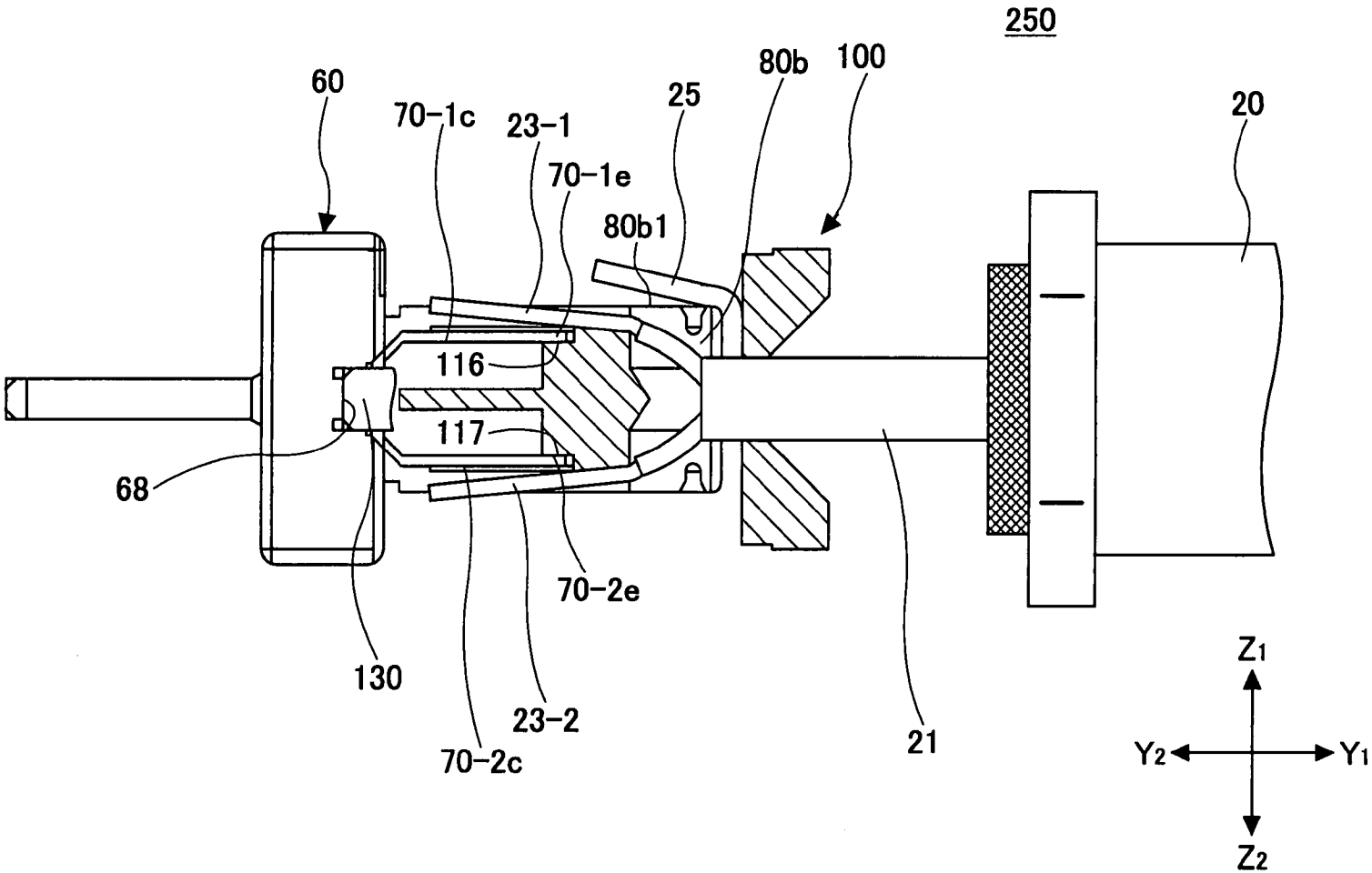
FIG. 14 is a diagram showing a state where the alignment member and the contact assembly are joined according to the embodiment of the present invention.

As shown in FIG. 13, the alignment member 100, retaining the aligned pair wires 21 and the aligned first and second signal wires 23-1 and 23-2, and the contact assembly 60 are aligned, and are caused to face and approach each other so that the alignment member 100 is joined to the rear side of the contact assembly 60 as shown in FIG. 14. As a result, a differential transmission cable connector temporary assembly 250 is obtained.

The projecting shield parts 80*b* first enter the corresponding slits 122, and then, the corresponding slits 115. Further, each tooth 121 enters the space between the corresponding beam parts 70-1*c* and 70-2*c*. The horizontal part 118 is fitted into the cutouts 80*d*. The arm parts 130 and 131 are fitted into the recesses 68 and 69, respectively, of the block body 61.

Thus, as a result of the fitting of the projecting shield parts 80*b* into the slits 122 and 115 and the fitting of the arm parts 130 and 131 into the recesses 68 and 69, the alignment member 100 is positioned with respect to the contact assembly 60 and joined thereto.

As shown in FIG. 14, each first signal wire 23-1 is positioned near and opposite the upper surface 70-1*d* (FIG. 8A) of the corresponding beam part 70-1*c*, and each second signal wire 23-2 is positioned near and opposite the lower surface 70-2*d* (FIG. 8A) of the corresponding beam part 70-2*c*. The position of each drain wire 25 is suitably adjusted so that the drain wire 25 comes into contact with the $Y_1$-side upper corner of the corresponding projecting shield part 80*b* so as to be bent to be positioned near and opposite the $Z_1$-side end surface part 80*b*1 of the projecting shield part 80*b*.

The position of the end portion 70-1*e* of each beam part 70-1*c* is controlled by the corresponding beam support part 116, and the end portion 70-1*e* is supported thereby. The position of the end portion 70-2*e* of each beam part 70-2*c* is controlled by the corresponding beam support part 117, and the end portion 70-2*e* is supported thereby.

Instead of the above-described configuration, it is also possible to provide the arm parts 130 and 131 to the block body 61 and provide the recesses 68 and 69 to the alignment member 100.

(c) Welding Process

Figure 15:
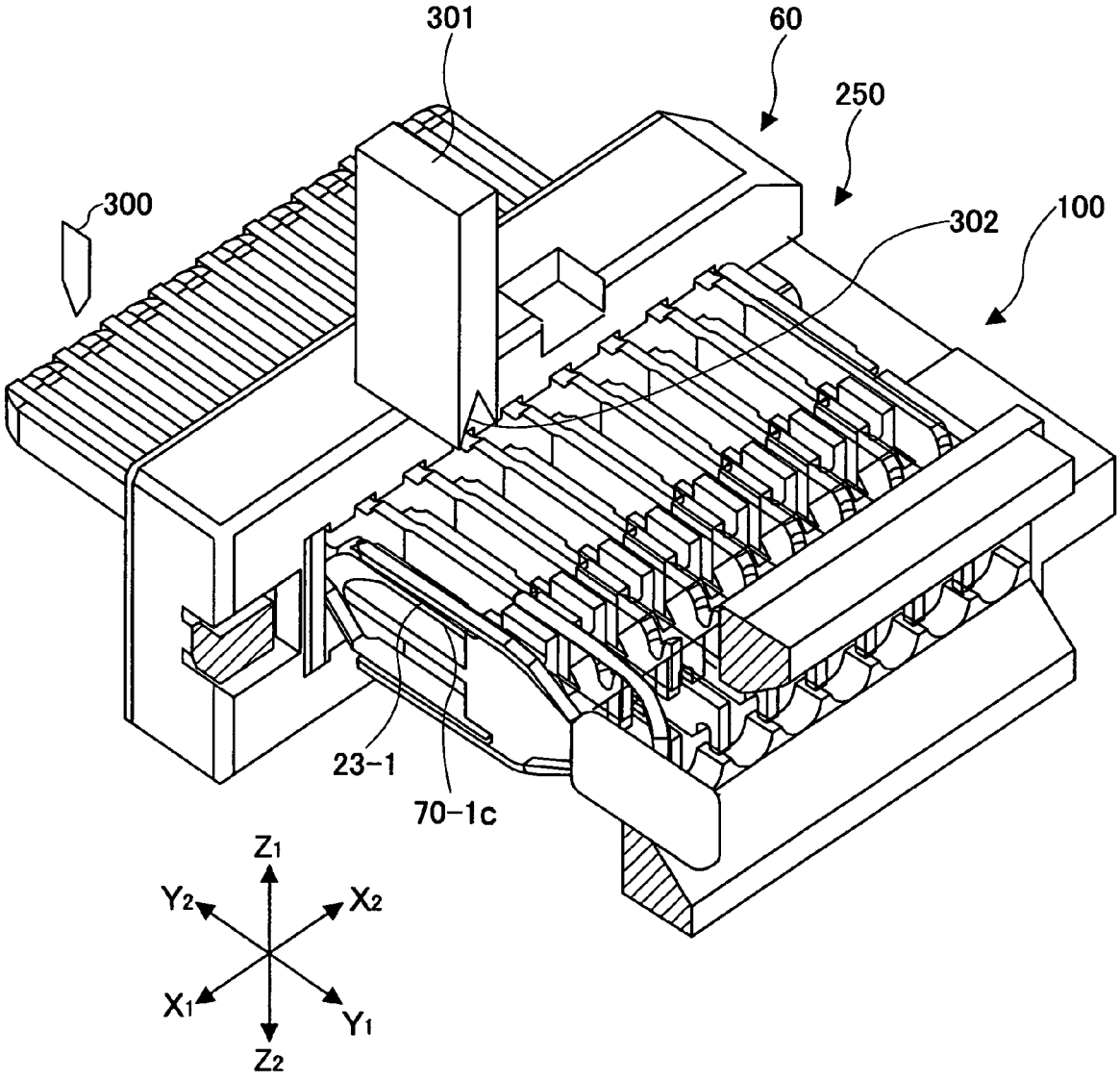
FIG. 15 is a diagram for illustrating the electric welding of the wires to the contacts according to the embodiment of the present invention.

The welding process is performed using a welding jig (not graphically represented). As shown in FIG. 15, the welding jig includes a negative (−) welding electrode 300 and a positive (+) welding electrode 301. An inverse V-shaped groove 302 is formed on an end of the positive welding electrode 301.

Figure 16A:
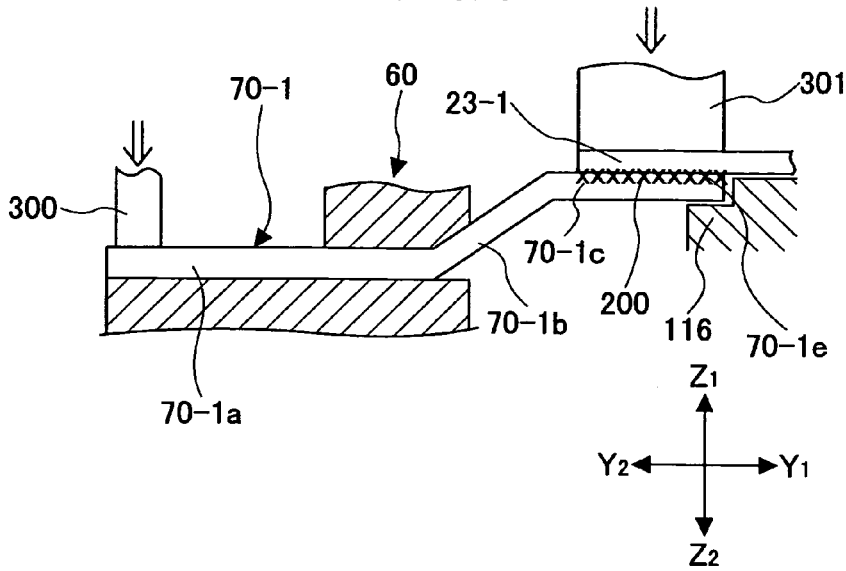
FIGS. 16A through 16C are diagrams for illustrating the electric welding of the signal wires to the signal contacts according to the embodiment of the present invention.

As shown in FIGS. 15 and 16A, the differential transmission cable connector temporary assembly 250 is set in the welding jig. The negative welding electrode 300 is brought into contact with the contact part 70-1*a*, and the first signal wire 23-1 is pressed against the beam part 70-1*c* by the positive welding electrode 301. As a result, a welding current flows through the signal contact 70-1, so that the welded part 200 is formed. Thus, the first signal wire 23-1 is welded to the beam part 70-1*c* by electric welding.

Figure 16B:
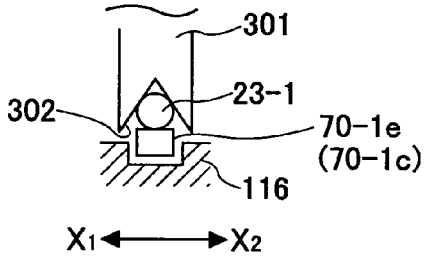

The beam part 70-1*c* is narrow in width. However, as shown in FIG. 16B, the groove 302 straddles the beam part 70-1*c* on its entrance side so as to prevent the positive electrode 301 from being offset from the beam part 70-1*c*. Therefore, the positive welding electrode 301 is stably pressed against the beam part 70-1*c*. Further, the bottom part of the groove 302 holds the first signal wire 23-1. Accordingly, the first signal wire 23-1 is welded to the beam part 70-1*c*, being positioned along the center of the upper surface 70-1*d* of the beam part 70-1*c* along the Y-axis.

Further, as shown in FIG. 16A, the end portion 70-1*e* of the beam part 70-1*c* is supported by the beam support part 116 so that the beam part 70-1*c* is prevented from deflecting freely. As a result, it is ensured that the first signal wire 23-1 is pressed against the beam part 70-1*c*, so that the above-described electric welding is performed satisfactorily.

The electric welding of the each second signal wire 23-2 to the corresponding beam part 70-2*c* is performed in the same way as described above, so that the welded part 201 is formed.

Figure 16C:
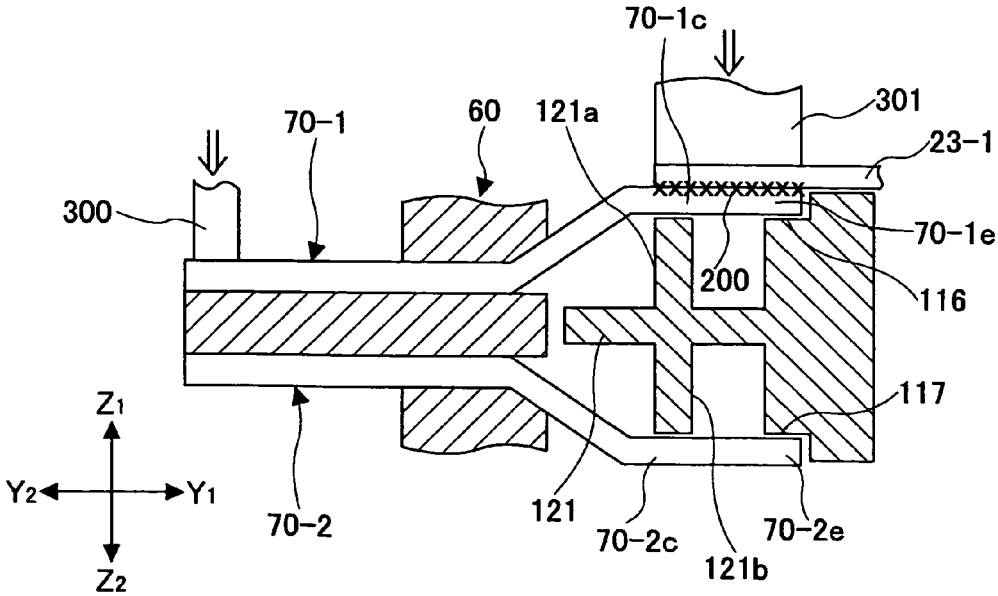

As shown in FIG. 16C, support parts 121*a* and 121*b* may be formed on each tooth 121 so as to project upward and downward therefrom in order to support the intermediate portions of the beam parts 70-1*c* and 70-2*c*, respectively. As a result, the deflection of the beam parts 70-1*c* and 70-2*c* is controlled, so that the above-described electric welding is performed with more reliability.

Figure 17A:
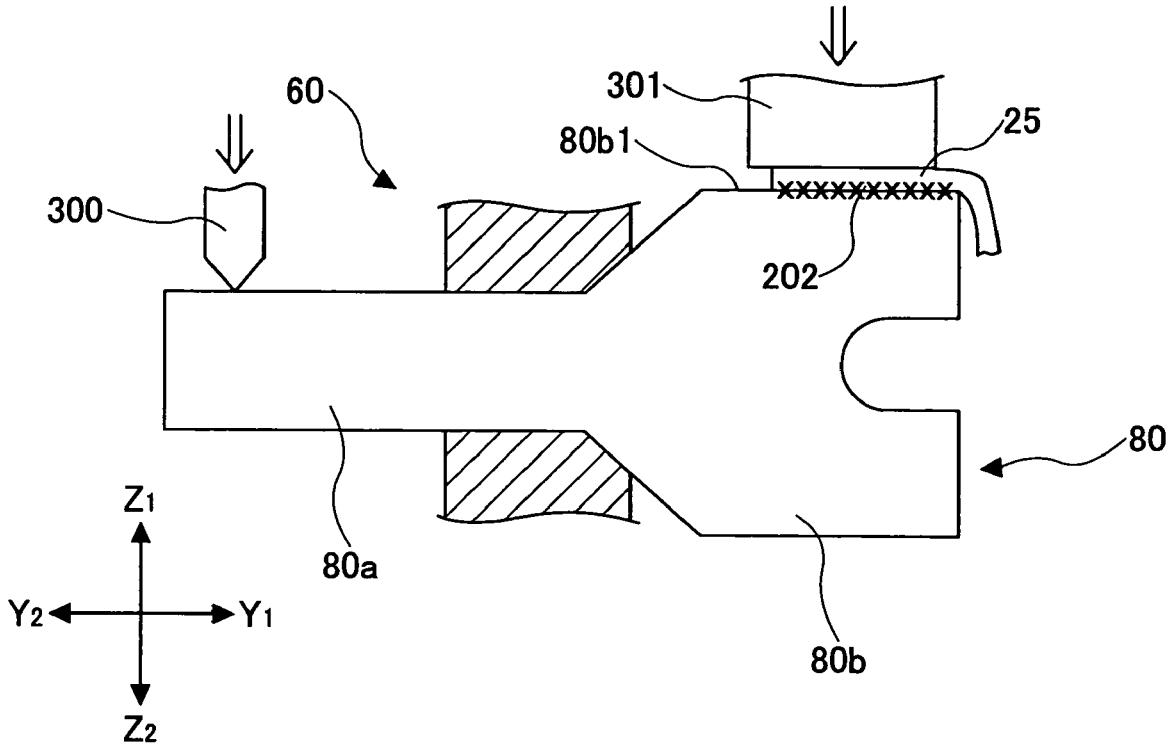
FIGS. 17A and 17B are diagrams for illustrating the electric welding of the drain wires to the ground contacts according to the embodiment of the present invention.
Figure 17B:
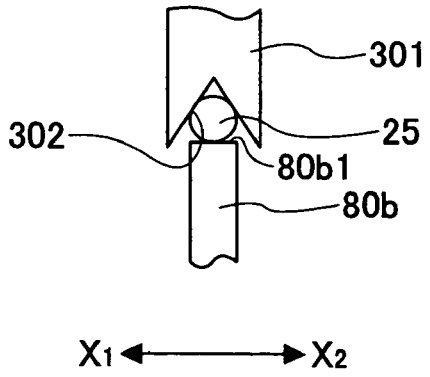

The welding of the drain wires 25 is performed as follows. As shown in FIG. 17A, the negative welding electrode 300 is brought into contact with the shield part 80*a*, and the drain wire 25 is pressed against the $Z_1$-side end surface part 80*b*1 of the projecting shield part 80*b* by the positive welding electrode 301. As a result, a welding current flows through the ground contact 80, so that the welded part 202 is formed. Thus, the drain wire 25 is welded to the projecting shield part 80*b* by electric welding. As shown in FIG. 17B, the groove 302 holds the drain wire 25, and the groove 302 straddles the $Z_1$-side end surface part 80*b*1 of the projecting shield part 80*b* to control the offsetting of the positive welding electrode 301 from the projecting shield part 80*b*. As a result, the drain wire 25 is welded to the projecting shield part 80*b*, being positioned along the $Z_1$-side end surface part 80*b*1 of the projecting shield part 80*b*, although the $Z_1$-side end surface part 80*b*1 is narrow in width.

Thus, each drain wire 25 is welded to the $Z_1$-side end surface part 80*b*1 of the corresponding projecting shield part 80*b* as described above.

The alignment member 100 is joined to the contact assembly 60, thereby forming the differential transmission cable connector temporary assembly 250 as a unit. The first and second signal wires 23-1 and 23-2 are maintained in positions near and opposite the beam parts 70-1*c* and 70-2*c*, respectively. The drain wires 25 are maintained in positions near and opposite the projecting shield parts 80*b*. Even in the case of turning the differential transmission cable connector temporary assembly 250 upside down to perform electric welding on the second signal wires 23-2, the positions of the second signal wires 23-2 relative to the beam parts 70-2*c* are maintained. Accordingly, there is no need to modify the positions of the first and second signal wires 23-1 and 23-2 and the drain wires 25 at the time of performing electric welding, so that electric welding is performed with efficiency. The number of processes of electric welding is reduced compared with that of soldering using a soldering iron.

As a result of the above-described processes, the differential transmission cable connector 50 is completed.

According to the present invention, the first and second signal wires 23-1 and 23-2 and the drain wires 25 of the differential transmission cable 20 are directly connected to the first and second signal contacts 70-1 and 70-2 and the ground contacts 80, respectively, of the contact assembly 60. Further, the rear ends of the ground contacts 80 extend further in the rear ($Y_1$) direction than those of the first and second signal contacts 70-1 and 70-2. Accordingly, a better shield is provided between a differential signal transmission channel and another differential signal transmission channel adjacent thereto, thus resulting in better transmission characteristics. Therefore, this differential transmission cable connector 50 is employable for a high-speed signal transmission channel.

Further, the alignment member 100, aligning the pair wires 21 and the first and second signal wires 23-1 and 23-2 to the contact assembly 60, is joined to the contact assembly 60, thereby forming the differential transmission cable connector temporary assembly 250. Since electric welding is performed with respect to the temporary assembly 250, the welding of the first and second signal wires 23-1 and 23-2 to the first and second signal contacts 70-1 and 70-2 and the welding of the drain wires 25 to the ground contacts 80 can be performed with good operability.

Thus, the alignment member 100 to be connected to the contact assembly 60 is employed, and electric welding is performed with efficiency. As a result, the differential transmission cable connector 50 is manufactured with good productivity.

The present invention is not limited to the specifically disclosed embodiment, and variations and modifications may be made without departing from the scope of the present invention.

The present application is based on Japanese Priority Patent Application No. 2004-74922, filed on Mar. 16, 2004, the entire contents of which are hereby incorporated by reference.

What is claimed is:

1. A cable connector for differential transmission, comprising:

a contact assembly including an electrically insulating block body in which signal contact pairs and ground contacts are incorporated to be arranged side by side alternately, the signal contact pairs each being formed of first and second signal contacts, the first signal contact having a first signal wire connection part thereof projecting from a surface of the block body, the second signal contact having a second signal wire connection part thereof projecting from the surface of the block body, the ground contacts each having a drain wire connection part thereof projecting from the surface of the block body; and an alignment member including a signal wire alignment part and a joining part joined to the contact assembly, the signal wire alignment part being configured to align first signal wires and second signal wires extending from an end of a differential transmission cable so that the first and second signal wires are arranged in positions corresponding to the first and second signal wire connection parts, respectively, wherein the alignment member is joined to the contact assembly through the joining part on a side of the surface of the block body, the differential transmission cable includes a plurality of pair wires each formed of a corresponding one of the first signal wires, a corresponding one of the second signal wires, and a drain wire, the first and second signal wires are connected to the first and second signal wire connection parts, respectively, and the drain wires are connected to the drain wire connection parts.

2. The cable connector as claimed in claim 1, wherein:

the joining part of the alignment member includes first and second arm parts extending toward the contact assembly;

the contact assembly includes first and second fitting parts into which the first and second arm parts, respectively, are fitted, the first and second fitting parts being provided on the surface of the block body in positions separate from each other; and the first and second arm parts are fitted into the first and second fitting parts, respectively, so that the alignment member is joined to the contact assembly.

3. The cable connector as claimed in claim 1, wherein:

the alignment member further includes a comb teeth part extending from the signal wire alignment part toward the contact assembly; and the comb teeth part is provided between the first signal wires and the second signal wires.

4. The cable connector as claimed in claim 1, wherein:

the alignment member further includes a support part configured to support an end portion of each of the first and second signal wire connection parts, the support part being provided on a side of the signal wire alignment part on which side the signal wire alignment part opposes the contact assembly; and the end portions of the first and second signal wire connection parts are supported by the support part.

5. The cable connector as claimed in claim 1, wherein:

the first and second signal wires are welded to the first and second signal wire connection parts, respectively, by electric welding; and the drain wires are welded to the drain wire connection parts by electric welding.

6. A cable connector for differential transmission, comprising:

a contact assembly including an electrically insulating block body in which signal contact pairs and ground contacts are incorporated to be arranged side by side alternately, the signal contact pairs each being formed of first and second signal contacts, the first signal contact having a first signal wire connection part thereof projecting from a surface of the block body, the second signal contact having a second signal wire connection part thereof projecting from the surface of the block body, the ground contacts each having a drain wire connection part thereof projecting from the surface of the block body; and an alignment member including a pair wire alignment part and a joining part joined to the contact assembly, the pair wire alignment part being configured to align a plurality of pair wires included in a differential transmission cable in a direction in which the signal contact pairs and the ground contacts are arranged side by side alternately, wherein the alignment member is joined to the contact assembly through the joining part on a side of the surface of the block body, each of the pair wires is formed of a first signal wire, a second signal wire, and a drain wire, the first and second signal wires are connected to the first and second signal wire connection parts, respectively, and the drain wires are connected to the drain wire connection parts.

7. The cable connector as claimed in claim 6, wherein:

the joining part of the alignment member includes first and second arm parts extending toward the contact assembly;

the contact assembly includes first and second fitting parts into which the first and second arm parts, respectively, are fitted, the first and second fitting parts being provided on the surface of the block body in positions separate from each other; and the first and second arm parts are fitted into the first and second fitting parts, respectively, so that the alignment member is joined to the contact assembly.

8. The cable connector as claimed in claim 6, wherein:

the first and second signal wires are welded to the first and second signal wire connection parts, respectively, by electric welding; and the drain wires are welded to the drain wire connection parts by electric welding.

9. A cable connector for differential transmission, comprising:

a contact assembly including an electrically insulating block body in which signal contact pairs and ground contacts are incorporated to be arranged side by side alternately, the signal contact pairs each being formed of first and second signal contacts, the first signal contact having a first signal wire connection part thereof projecting from a surface of the block body, the second signal contact having a second signal wire connection part thereof projecting from the surface of the block body, the ground contacts each having a drain wire connection part thereof projecting from the surface of the block body; and an alignment member including a pair wire alignment part, a signal wire alignment part, and a joining part joined to the contact assembly, the pair wire alignment part being configured to align a plurality of pair wires included in a differential transmission cable in a direction in which the signal contact pairs and the ground contacts are arranged side by side alternately, the pair wires each being formed of a first signal wire, a second signal wire, and a drain wire, the signal wire alignment part being configured to align the first and second signal wires extending from an end of the differential transmission cable so that the first and second signal wires are arranged in positions corresponding to the first and second signal wire connection parts, respectively, wherein the alignment member is joined to the contact assembly through the joining part on a side of the surface of the block body, the first and second signal wires are connected to the first and second signal wire connection parts, respectively, and the drain wires are connected to the drain wire connection parts.

10. The cable connector as claimed in claim 9, wherein:

the joining part of the alignment member includes first and second arm parts extending toward the contact assembly;

the contact assembly includes first and second fitting parts into which the first and second arm parts, respectively, are fitted, the first and second fitting parts being provided on the surface of the block body in positions separate from each other; and the first and second arm parts are fitted into the first and second fitting parts, respectively, so that the alignment member is joined to the contact assembly.

11. The cable connector as claimed in claim 9, wherein:

the joining part of the alignment member includes first and second arm parts extending toward the contact assembly from first and second sides, respectively, of the pair wire alignment part, the first and second sides being opposite each other in the direction in which the pair wires are aligned;

the signal wire alignment part is provided to extend between the first and second arm parts and oppose the pair wire alignment part with a space between the signal wire alignment part and the pair wire alignment part;

the contact assembly includes first and second fitting parts into which the first and second arms, respectively, are fitted, the first and second fitting parts being provided on the surface of the block body in positions separate from each other; and the first and second arms are fitted into the first and second fitting parts, respectively, so that the alignment member is joined to the contact assembly.

12. The cable connector as claimed in claim 9, wherein:

the alignment member further includes a comb teeth part extending from the signal wire alignment part toward the contact assembly; and the comb teeth part is provided between the first signal wires and the second signal wires.

13. The cable connector as claimed in claim 9, wherein:

the alignment member further includes a support part configured to support an end portion of each of the first and second signal wire connection parts, the support part being provided on a side of the signal wire alignment part on which side the signal wire alignment part opposes the contact assembly; and the end portions of the first and second signal wire connection parts are supported by the support part.

14. The cable connector as claimed in claim 9, wherein the alignment member further includes a guide part provided on a side of the signal wire alignment part on which side the signal wire alignment part opposes the pair wire alignment part, the guide part being configured to guide the first and second signal wires, approaching from the pair wire alignment part, toward the first and second signal wire connection parts, respectively.

15. The cable connector as claimed in claim 9, wherein:

the first and second signal wires are welded to the first and second signal wire connection parts, respectively, by electric welding; and the drain wires are welded to the drain wire connection parts by electric welding.

* * * * *